US012624494B2

(12) United States Patent
Jang et al.

(10) Patent No.: US 12,624,494 B2
(45) Date of Patent: May 12, 2026

(54) CLOTHES DRYER

(71) Applicant: SAMSUNG ELECTRONICS CO., LTD., Suwon-si (KR)

(72) Inventors: Jonghyun Jang, Suwon-si (KR); Ohjin Kwon, Suwon-si (KR); Seongryeol Myeong, Suwon-si (KR); Jaeryong Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 826 days.

(21) Appl. No.: 17/842,337

(22) Filed: Jun. 16, 2022

(65) Prior Publication Data

US 2023/0064492 A1 Mar. 2, 2023

Related U.S. Application Data

(63) Continuation of application No. PCT/KR2022/007105, filed on May 18, 2022.

(30) Foreign Application Priority Data

Aug. 27, 2021 (KR) ..... 10-2021-0113898
Oct. 26, 2021 (KR) ..... 10-2021-0143365

(51) Int. Cl.
*D06F 58/04* (2006.01)
*D06F 58/20* (2006.01)
*D06F 58/24* (2006.01)

(52) U.S. Cl.
CPC ..... *D06F 58/04* (2013.01); *D06F 58/206* (2013.01); *D06F 58/24* (2013.01)

(58) Field of Classification Search
CPC ..... D06F 58/04; D06F 58/206; D06F 58/24
See application file for complete search history.

(56) References Cited

U.S. PATENT DOCUMENTS 10,337,137 B2 * 7/2019 Jung ..... D06F 58/20
10,982,380 B2 4/2021 Jung et al.
(Continued)

FOREIGN PATENT DOCUMENTS

KR 10-1729107 4/2017
KR 10-2019-0128465 11/2019
(Continued)

OTHER PUBLICATIONS

English translation of KR 2019-0128465 (Year: 2019).*
(Continued)

*Primary Examiner* — Connor J Tremarche
(74) *Attorney, Agent, or Firm* — STAAS & HALSEY LLP

(57) ABSTRACT

A clothes dryer configured to improve a drying performance by facilitating discharge of condensed water. The clothes dryer includes a cabinet, a drum rotatably arranged inside the cabinet, a support plate provided in a lower portion of the cabinet, the support plate including an evaporator mounting member and a condenser mounting member adjacent to the evaporator member, an evaporator mounted in the evaporator mounting member, and a condenser mounted in the condenser mounting member, and a fan configured to generate a circulation airflow to circulate air through the evaporator, the condenser, and the drum. The evaporator member includes a plurality of drain holes to drain water collected on the first region therethrough, extending in a widthwise direction which is perpendicular to a direction of the circulation airflow, and each of the plurality of drain holes is spaced apart from one another along the direction of the circulation airflow.

12 Claims, 10 Drawing Sheets

(56) References Cited

U.S. PATENT DOCUMENTS

| | | | | |
|---|---|---|---|---|
| 2017/0343272 | A1 | 11/2017 | Miao et al. | |
| 2018/0148885 | A1* | 5/2018 | Kitayama | D06F 58/20 |
| 2018/0245272 | A1* | 8/2018 | Bocchino | D06F 58/22 |
| 2019/0284749 | A1 | 9/2019 | Dunn | |
| 2021/0189635 | A1 | 6/2021 | Jang et al. | |
| 2021/0230788 | A1 | 7/2021 | Lee et al. | |
| 2023/0193550 | A1 | 6/2023 | Bocchino et al. | |

FOREIGN PATENT DOCUMENTS

| | | | | |
|---|---|---|---|---|
| KR | 20190128465 | A | * | 11/2019 |
| KR | 10-2021-0020406 | A | | 2/2021 |
| KR | 10-2021-0020445 | A | | 2/2021 |
| KR | 20210020445 | A | * | 2/2021 |
| KR | 10-2021-0080039 | | | 6/2021 |

OTHER PUBLICATIONS

English translation of KR 2021-0020445 (Year: 2021).*
International Search Report dated Sep. 2, 2022 issued in PCT/KR2022/007105.
Written Opinion, PCT/ISA/237, dated Sep. 2, 2022 issued in PCT/KR2022/007105.

* cited by examiner

CLOTHES DRYER

CROSS-REFERENCE TO RELATED APPLICATION(S)

This application is a continuation application, under 35 U.S.C. § 111(a), of international application No. PCT/KR2022/007105, filed on May 18, 2022, which claims priority to Korean Patent Application No. 10-2021-0113898, filed on Aug. 27, 2021, and No. 10-2021-0143365, filed on Oct. 26, 2021 in the Korean Intellectual Property Office, the disclosure of which is incorporated by reference herein in their entireties

BACKGROUND

1. Field

The disclosure relates to a clothes dryer configured to improve a drying performance by facilitating discharge of condensed water.

2. Description of Related Art

A clothes dryer is a device that dries laundry with hot-dry air. The clothes dryer may include a cabinet, a heat pump device arranged inside the cabinet and including a condenser and an evaporator, a fan configured to generate an air flow in the cabinet, and a drum in which laundry is accommodated.

Air in the cabinet may be introduced into the drum through the evaporator and condenser by the flow of air generated by the fan. When moist air comes into contact with a cold surface of the evaporator, condensed water is generated on the surface of the evaporator. The condensed water may be discharged through a plurality of drain holes located below the evaporator, thereby preventing the condensed water from moving to the condenser.

However, some of the condensed water is not discharged through the drain hole, but may move to the condenser by the flow of air. Water moving to the condenser may vaporize due to the high temperature of the condenser. As the water around the condenser vaporizes, the humidity of the air passing through the condenser rises.

As the humidity of the air passing through the condenser rises, a drying time may be longer and the energy consumption may increase. That is, the drying performance of the clothes dryer may be reduced.

SUMMARY

Therefore, it is an aspect of the disclosure to provide a clothes dryer capable of improving a drying performance by facilitating discharge of condensed water.

It is another aspect of the disclosure to provide a clothes dryer capable of improving a structure, in which an evaporator is mounted, so as to prevent movement of condensed water, which is generated by the evaporator, toward a condenser caused by an air flow inside the clothes dryer.

It is another aspect of the disclosure to provide a clothes dryer capable of improving a drying performance without an increase in a material cost.

Additional aspects of the disclosure will be set forth in part in the description which follows and, in part, will be obvious from the description, or may be learned by practice of the disclosure.

In accordance with an aspect of the disclosure, a clothes dryer includes a cabinet, a drum rotatably arranged inside the cabinet, a support plate provided in a lower portion of the cabinet, the support plate including an evaporator mounting member and a condenser mounting member adjacent to the evaporator member, an evaporator mounted in the evaporator mounting member, and a condenser mounted in the condenser mounting member, and a fan configured to generate a circulation airflow to circulate air through the evaporator, the condenser, and the drum. The evaporator member includes a plurality of drain holes to drain water collected on the first region therethrough, extending in a widthwise direction which is perpendicular to a direction of the circulation airflow, and each of the plurality of drain holes is spaced apart from one another along the direction of the circulation airflow.

The evaporator mounting member includes plurality of connection ribs extending along the direction of the circulation airflow and to partition the plurality of the drain holes, respectively, and to reinforce a strength of the evaporator mounting member.

The evaporator mounting member may be in contact with the evaporator in a portion between two adjacent drain holes among the plurality of drain holes.

The plurality of connection ribs may be positioned lower than the evaporator mounting member.

An edge of the plurality of drain holes may be formed to be round to allow water around the plurality of drain holes to be guided to the plurality of drain holes.

Each of the plurality of connection ribs may include an upper surface convex in a first direction and concave in a second direction intersecting the first direction, so as to guide water downward.

The first direction may correspond to the widthwise direction.

The second direction may correspond to the direction of the circulation airflow.

The each of the plurality of connection ribs may be arranged space apart from each other in the widthwise direction.

the condenser mounting member may be positioned lower than the evaporator mounting member.

The support plate may include a prevention rib provided to prevent water from the evaporator mounting member from moving to the condenser mounting member due to the circulation airflow.

The prevention rib may be arranged between the evaporator mounting member and the condenser mounting member, and may extend in the widthwise direction.

The support plate may further include a connection member to connect the evaporator mounting member and the condenser mounting member, and including a first end connected to the evaporator mounting member, in which the evaporator is mounted, and a second end connected to the condenser mounting member to connect the evaporator mounting member.

The connection member includes a plurality of holes to drain water therethrough.

The second end of the connection member may be positioned lower than the first end of the connection member.

The prevention rib may be arranged on the second end.

The evaporator mounting member may include an evaporator support formed in a flat shape to increase a contact area with the evaporator.

The evaporator mounting member may include a curved member convex upward toward the evaporator.

A clothes dryer comprising a cabinet, a drum rotatably arranged inside the cabinet, a support plate provided in a lower portion of the cabinet, the support plate including a first region, a second region spaced apart from the first region, and a connection region provided between the first region and the second region, and connect the first region and second region together, an evaporator mounted on the first region, a condenser mounted on the second region, and a fan configured to generate a circulation airflow to circulate air through the evaporator, the condenser, and the drum.

The first region includes a plurality of drain holes to drain water collected on the first region therethrough, extending in a widthwise direction which is perpendicular to a direction of the circulation airflow, and each of the plurality of drain holes is spaced apart from one another along the direction of the circulation airflow, the connection region includes a plurality of holes extending in the widthwise direction to drain water collected from the first region therethrough.

The first region is located higher that the second region, and the connection region slopes downward from the first region and the second region to drain the collected water from the first region and the second region through the plurality of holes of the connection region.

The plurality of drain holes includes a plurality of connection ribs extending along the direction of the circulation airflow to partition the plurality of drain holes, respectively, and to reinforce a strength of the first region.

The plurality of connection ribs are located lower than a surface of the first region to guide condensed water on the evaporator to be discharged through the plurality of drain holes.

The connection ribs has an inclined portion toward the plurality of drain holes to guide the condensed water to be discharged through the plurality of drain holes.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
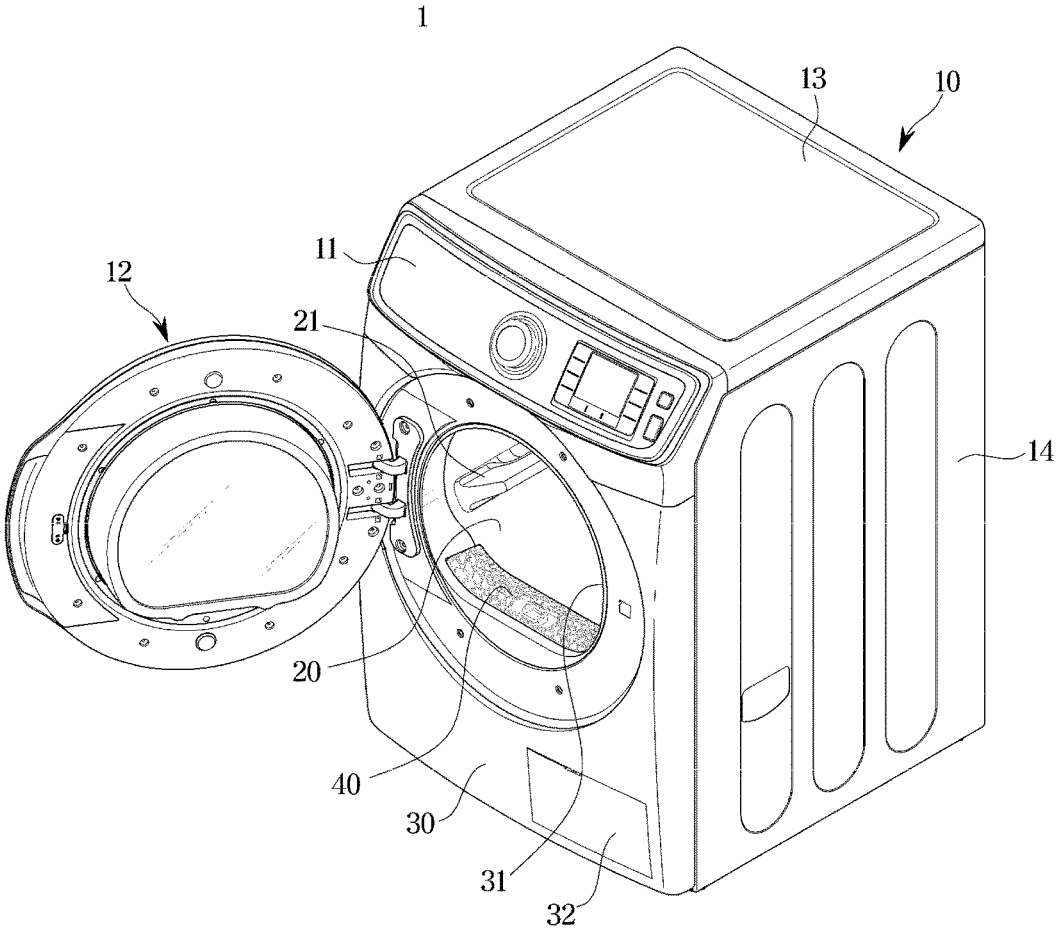
FIG. 1 is a perspective view of a clothes dryer according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context dearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "left", "right" and the like may be defined by the drawings, but the shape and the location of the component is not limited by the term.

In the disclosure, a region in which an evaporator is mounted may refer to an evaporator mounting member. In addition, a region in which a condenser is mounted may refer to a condenser mounting member.

The disclosure will be described more fully hereinafter with reference to the accompanying drawings.

Figure 2:
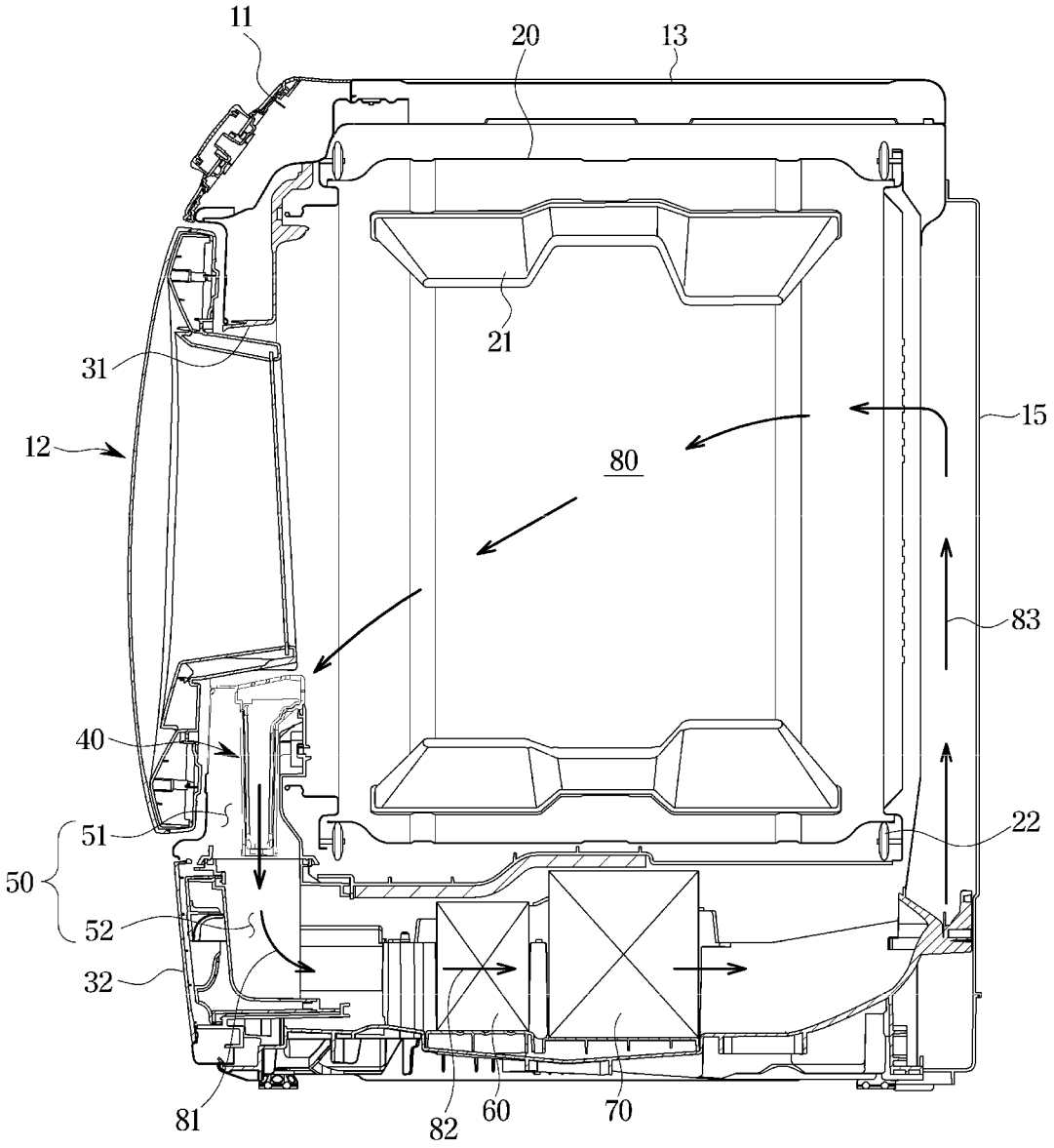
FIG. 2 is cross-sectional view of the clothes dryer according to an embodiment of the disclosure.

FIG. 1 is a perspective view of a clothes dryer according to an embodiment of the disclosure. FIG. 2 is cross-sectional view of the clothes dryer according to an embodiment of the disclosure.

Referring to FIGS. 1 and 2, a clothes dryer 1 may include a cabinet 10 forming an exterior and a drum 20 rotatably installed in the cabinet 10.

The cabinet 10 may be provided in a substantially hexahedral shape. A laundry inlet 31 may be formed on a front side of the cabinet 10 to insert or take clothes (not shown), which are objects to be dried, into or out of the drum 20. The laundry inlet 31 may be opened and closed by a door 12.

A control panel 11 configured to control an operation of the clothes dryer 1 may be provided on an upper front side of the cabinet 10. In the control panel 11, an inputter configured to receive an operation of the clothes dryer 1 may be provided in the form of a jog dial, and a display provided to display various information regarding the clothes dryer 1 may be provided. However, the disclosure is not limited thereto, and the control panel may include various types of inputters and displays.

The drum 20 in a cylindrical shape may be provided inside the cabinet 10. The drum 20 may be rotatable by receiving power from a drive device.

The cabinet 10 may include a front cover 30 forming a front surface, a top cover 13 forming an upper surface, a side cover 14 forming a side surface, a rear cover 15 forming a rear surface, and a support plate 100 forming a lower surface. According to an embodiment, the front cover 30 forming the front surface of the cabinet 10, the top cover 13, the side cover 14, the rear cover 15, and the support plate 100 may be separately formed and assembled to each other. Alternatively, at least two of the front cover, the top cover, the side cover, the rear cover, and the base plate may be integrally formed with each other.

The clothes dryer 1 may include the door 12 configured to open and close the laundry inlet 31 formed by opening the front cover 30. After a user opens the door 12, the user can put an object to be dried into or discharge the object from the inside of the drum 20 through the laundry inlet 31.

A heat exchanger cover 32 provided to allow a user to access an evaporator 60 may be detachably mounted on the front cover 30 of the cabinet 10.

According to an embodiment of the disclosure, the clothes dryer 1 may include a filter device 40 detachably mounted on the front cover 30. The filter device 40 may be provided to filter out foreign substances contained in the air inside the drum.

Hereinafter a basic operation of the clothes dryer 1 and a flow of air in the clothes dryer 1 will be described with reference to FIG. 2.

The drum 20 may be provided inside the cabinet 10 so as to be rotatable about a rotating axis provided substantially horizontally with the ground. A lifter 21 may be provided on an inner circumferential surface of the drum 20 to lift the object to be dried in response to the rotation of the drum 20. As the drum 20 rotates, the object to be dried may repeat a motion of rising and falling by the lifter 21. A roller 22 may be provided on an outer circumferential surface of the drum to support the drum 20 to rotate smoothly.

The drum 20 may be installed to be rotatable by receiving power by a drive device. The drive device may be arranged in an inner lower portion of the cabinet 10. The drive device may be mounted to the base.

The drive device may include a motor (not shown), a pulley (not shown) and a belt (not shown) for transmitting the power of the motor to the drum 20. The pulley may be connected to a rotating shaft (not shown) connected to the motor. In response to the rotation of the rotating shaft by the motor, the pulley may rotate together with the rotating shaft. The belt may be installed to be wound around an outer surface of the pulley and an outer surface of the drum 20. In response to the rotation of the belt by a driving force of the motor, the drum 20 may rotate together with the belt.

The drum 20 is provided to allow the object to be dried to be accommodated therein and to be dried. A flow path 80 provided to circulate dry air to the drum 20 may be formed in the cabinet 10. In addition, a fan (not shown) may be provided in a lower rear portion of the cabinet 10 to allow air to flow along the flow path 80. In the cabinet 10, the fan may form circulation airflow that passes through the drum 20.

The flow path 80 may include an exhaust flow path 81 provided to discharge air from the inside of the drum 20 to the outside of the drum 20, a connection flow path 82 provided to dry the air discharged from the drum 20, and a supply flow path 83 provided to supply the dried air to the inside of the drum 20.

The filter device 40 may be arranged in the exhaust flow path 81 so as to filter out foreign substances contained in the air inside the drum 20. The evaporator 60 and a condenser 70 may be sequentially arranged in the connection flow path 82. The air may be dried at the high temperature while passing through the connection flow path 82. The air, which is dried at the high temperature and in which foreign substances are filtered out while passing through the exhaust flow path 81 and the connection flow path 82, may be supplied back to the inside of the drum 20 by passing through the supply flow path 83. The object to be dried inside the drum 20 may be dried by the high-temperature dry air. The air that dried the object to be dried may change to a high-temperature and high-humidity state, and the high-temperature and high-humidity air in the drum 20 may be discharged to the outside of the drum 20 through the exhaust flow path 81.

The clothes dryer 1 may dry the object to be dried inside the drum 20 while repeating the above-described process.

In addition, the clothes dryer 1 may include an exhaust duct 50 forming the exhaust flow path 81. The exhaust duct 50 may include a filter duct 51 forming an outlet, through which the inside air of the drum 20 is discharged, and on which the filter device 40 is arranged, and a guide duct 52 provided to guide air from the filter duct 51 to the heat exchangers 60 and 70.

The heat exchangers 60 and 70 may include the evaporator 60 and the condenser 70. Although not specifically shown in the drawings, a compressor and an expansion valve may be provided in the lower portion of the cabinet 10. Accordingly, the evaporator, the condenser, the compressor, and the expansion valve may form a heat pump.

Figure 3:
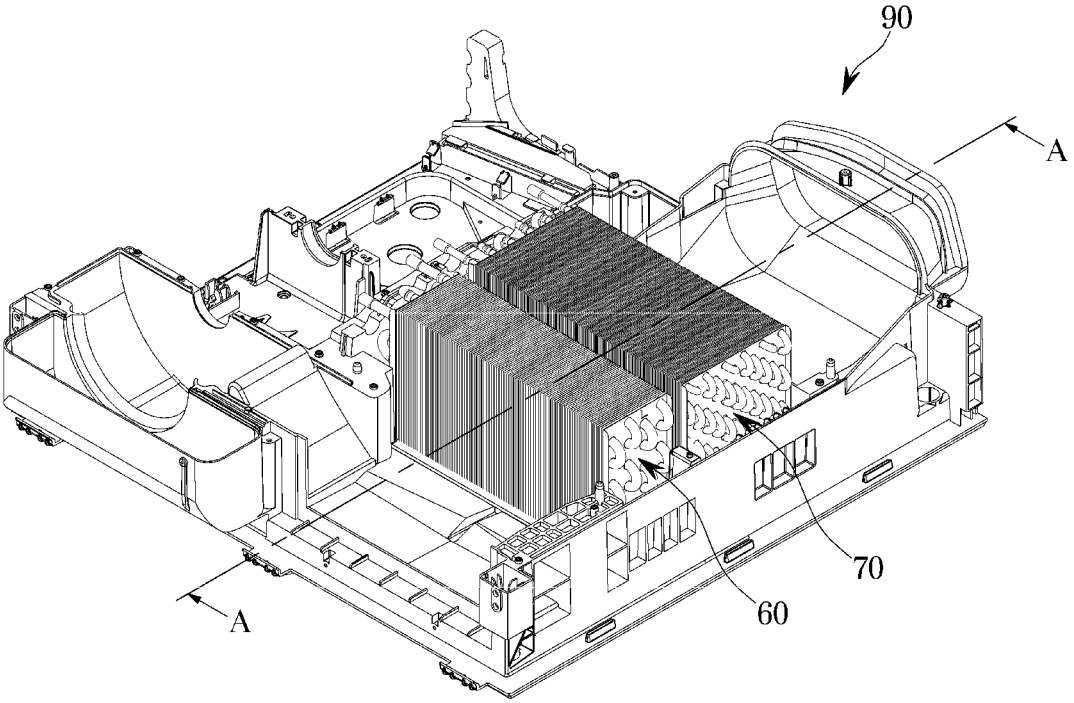
FIG. 3 is a view illustrating a base plate, an evaporator and a condenser separated from the clothes dryer according to an embodiment of the disclosure.
Figure 4:
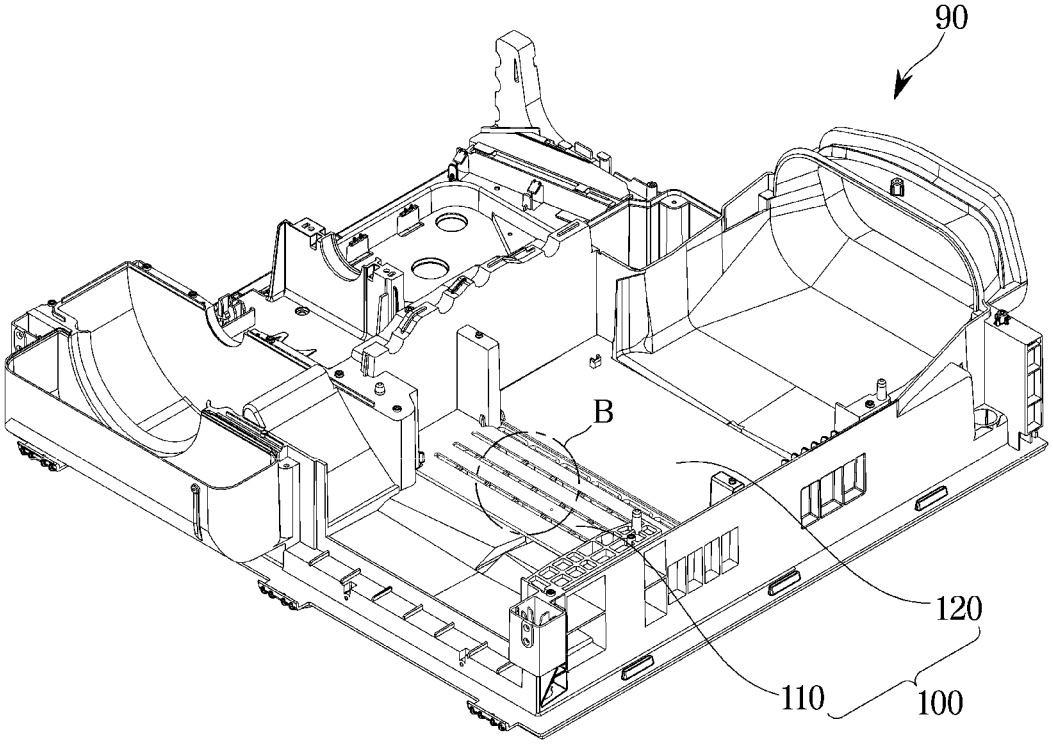
FIG. 4 is a view illustrating a state in which the evaporator and the condenser are removed from FIG. 3.

FIG. 3 is a view illustrating a base plate, an evaporator and a condenser separated from the clothes dryer according to an embodiment of the disclosure. FIG. 4 is a view illustrating a state in which the evaporator and the condenser are removed from FIG. 3.

Referring to FIGS. 3 and 4, the clothes dryer 1 according to an embodiment may include a base plate 90 forming a lower surface of the cabinet 10. The evaporator 60 and the condenser 70 corresponding to the heat exchangers may be mounted on the base plate 90.

The evaporator 60 and the condenser 70 may be arranged side by side with a predetermined distance. The flow of air generated by the fan (not shown) may be introduced into the condenser 70 after passing through the evaporator 60. The circulation airflow formed by the fan may circulate inside the cabinet 10 through the evaporator 60, the condenser 70, and the drum 20 in sequence. The high-temperature and high-humidity air that passed through the inside of the drum 20 may change to condensed water and low-temperature and low-humidity air while passing through the evaporator 60 including a cold surface. In this case, the condensed water may be generated on the surface of the evaporator 60, and move downward by gravity along the surface of the evaporator 60. The condensed water moving down the evaporator 60 may move to the base plate 90 through an opening 113 provided under the evaporator 60. The water moving to the base plate 90 may move to a sump (not shown), in which the condensed water is stored, along an inclined surface.

Referring to FIGS. 3 and 4, an evaporator mounting member 110 provided to mount the evaporator 60 and a condenser mounting member 120 provided to mount the condenser 70 may be arranged side by side. According to an embodiment, the support plate 100 provided to be coupled to the base plate 90 may include the evaporator mounting member 110 and the condenser mounting member 120. According to an embodiment, the evaporator mounting member 110 and the condenser mounting member 120 may be integrally formed with each other. However, the disclosure is not limited thereto. The evaporator mounting member and the condenser mounting member may be provided separately, and may be respectively coupled to the base plate.

Figure 5:
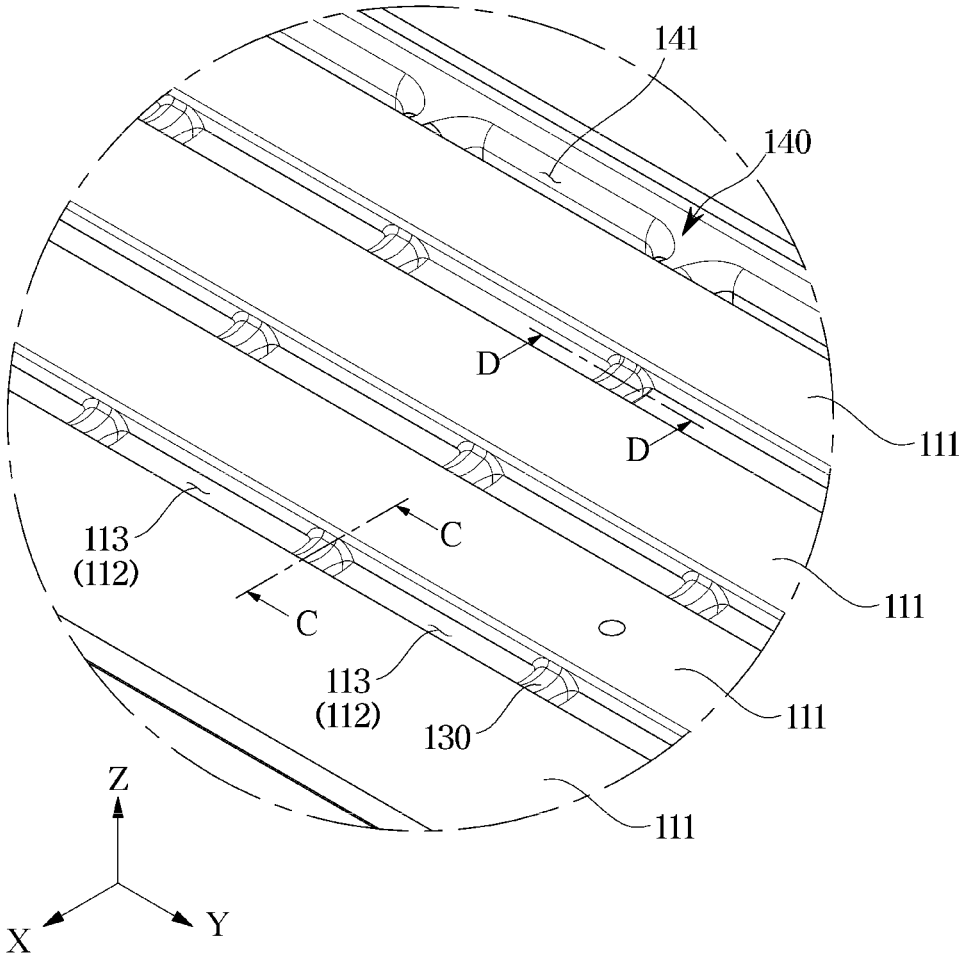
FIG. 5 is an enlarged view of a part B of FIG. 4.

FIG. 5 is an enlarged view illustrating a part B of FIG. 4.

Referring to FIG. 5, the evaporator mounting member 110 may include an evaporator support 111 provided to support the evaporator 60 by being in contact with the evaporator 60, and a drain hole 112 formed to penetrate the evaporator support 111.

The drain hole 112 may be provided to discharge the condensed water generated in the evaporator 60 to the base plate 90. The drain hole 112 may be provided to extend along a first direction. The first direction may indicate the Y-axis direction shown in FIG. 5. In addition, the first direction may indicate a width direction of the circulation airflow formed by the fan.

The evaporator mounting member 110 may include a plurality of drain holes 112 spaced apart from each other in a second direction perpendicular to the first direction. The second direction may indicate the X-axis direction shown in FIG. 5. In addition, the second direction may indicate a moving direction of the circulation airflow formed by the fan.

According to an embodiment, a connection rib 130 may be provided in the drain hole 112 extending in the first direction. The connection rib 130 may extend in the second direction in the drain hole 112 so as to partition the drain hole 112. The connection rib 130 may form a plurality of openings 113 in the drain hole 112 by partitioning the drain hole 112. In other words, the plurality of openings 113 spaced apart from each other in the first direction may form the drain hole 112.

The connection rib 130 may include a plurality of connection ribs 130 spaced apart from each other along the first direction in which the drain hole 112 extends.

The drain hole 112 may include a plurality of drain holes 112 spaced apart from each other in the second direction.

The connection rib 130 may not only partition the drain hole 112 but also reinforce a strength of the evaporator mounting member 110. If the connection rib 130 is not provided in the drain hole 112 extending in the first direction, the plurality of evaporator supports 111 spaced apart along the second direction may not support the evaporator 60 and thus the evaporator 60 may be damaged. The connection rib 130 may be provided to connect two evaporator supports 111 adjacent to each other in the drain hole 112. The connection rib 130 may connect two evaporator supports 111 adjacent to each other, thereby reinforcing a strength of the evaporator support 111. Accordingly, the evaporator support 111 may stably support the evaporator 60.

As shown in FIG. 5, an edge 114 of the drain hole 112 may be formed to be round. The edge 114 of the drain hole 112 may be formed to be round so as to guide water around the drain hole 112 to the drain hole 112. Particularly, the edge 114 of the drain hole 112 may be provided to be inclined downwardly from the evaporator support 111 toward the drain hole 112, and may be provided in a curved shape. With this structure, water located in the periphery of the drain hole 112 may be guided to the drain hole 112 along the edge 114 of the drain hole 112.

Figure 6:
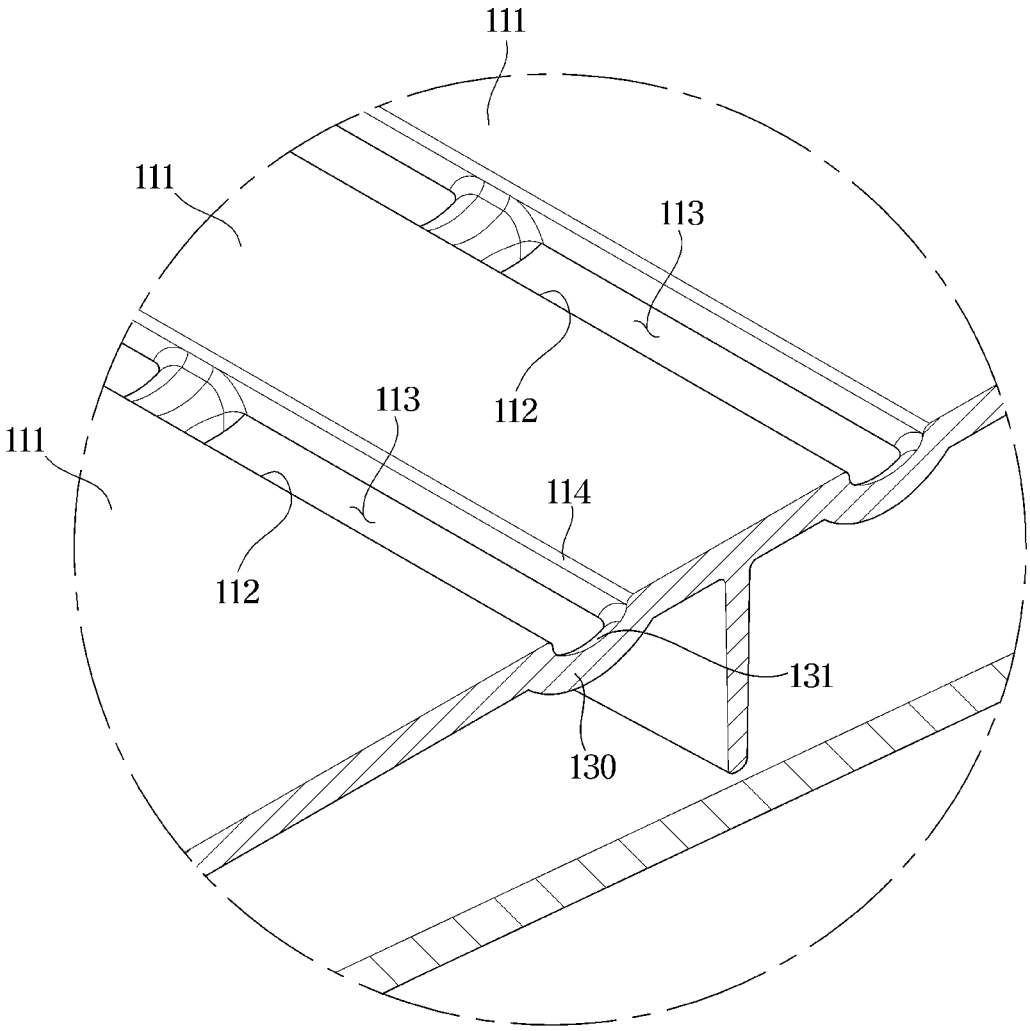
FIG. 6 is a cross-sectional perspective view taken along line C-C of FIG. 5.
Figure 7:
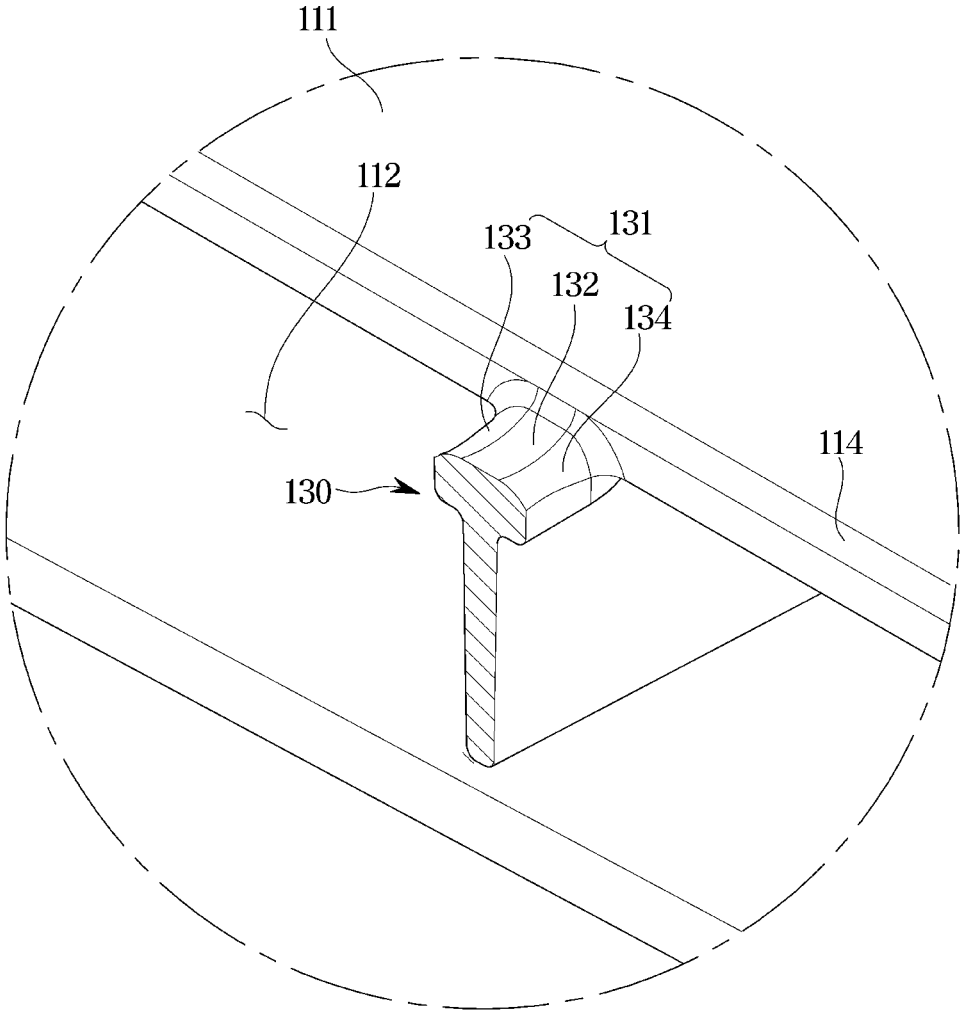
FIG. 7 is a cross-sectional perspective view taken along line D-D of FIG. 5.

FIG. 6 is a cross-sectional perspective view taken along line C-C of FIG. 5. FIG. 7 is a cross-sectional perspective view taken along line D-D of FIG. 5.

Hereinafter the structure of the connection rib according to an embodiment will be described in detail with reference to FIGS. 6 and 7.

Referring to FIG. 6, the connection rib 130 according to an embodiment may be provided to cross the drain hole 112. The connection rib 130 may partition the drain hole 112, which extends in the first direction, by crossing the drain hole 112 with respect to the second direction perpendicular to the first direction. The connection rib 130 may form the plurality of openings 113 in the drain hole 112 by partitioning the drain hole 112.

The connection rib 130 may be formed in a concave shape along the second direction. Particularly, an upper surface 131 of the connection rib 130 may be provided to include a curved shape that is concave along the second direction. Accordingly, water located on the upper surface 131 of the connection rib 130 may be guided under the connection rib 130. As described above, the second direction may correspond to the moving direction of the circulation airflow.

Referring to FIG. 7, a shape of a cross-section of the connection rib 130 by a plane perpendicular to the second direction may be formed in a shape in which opposite ends are rounded. The cross-section of the connection rib 130 by the plane may include a flat member 132 arranged in the center, and a first round member 133 and a second round member 134 arranged on opposite sides thereof. With this structure, the water located on the upper surface 131 of the connection rib 130 may flow to one side of the connection rib 130 by being guided by the first round member 133 or flow to the other side of the connection rib 130 by being guided by the second round member 134. Water located on the upper surface 131 of the connection rib 130 may be guided downward by the first round member 133 and the second round member 134.

Unlike that shown in FIG. 7, the connection rib 130 may be formed to be convex in the first direction. In other words, the connection rib 130 may be formed to be convex such that a central point in the first direction is located at the highest point. The upper surface 131 of the connection rib 130 may not include a flat surface, and the entire section may be provided as a curved surface in the first direction. As described above, the first direction may correspond to the width direction with respect to the circulation airflow.

That the upper surface of the connection rib 130 is convex in the first direction may include that opposite side ends of the cross-sectional shape of the connection rib 130 by the plane perpendicular to the second direction are rounded, and include that the upper surface is provided as a curved surface convex over the entire section along the first direction.

Referring to FIGS. 6 and 7, the connection rib 130 according to an embodiment may be provided to be positioned lower than the evaporator support 111. Because the connection rib 130 is positioned lower than the evaporator support 111, the connection rib 130 may not interfere with the movement of water located on the evaporator support 111.

The connection rib 130 according to an embodiment may be formed to be convex along the first direction and concave along the second direction. The connection rib 130 may be provided to be inclined with respect to the first direction, and may also be provided to be inclined with respect to the second direction. The connection rib 130 may be provided to include a double inclined structure. Because the connection rib 130 is provided to be inclined in the first and second directions perpendicular to each other, respectively, water located on the upper surface 131 of the connection rib 130 may be guided under the connection rib 130. That is, the water may be discharged to the base plate 90 through the opening 113.

Conventionally, a portion of the condensed water generated in the evaporator is not discharged through a plurality of drain holes located below the evaporator, but moves toward the condenser by the air flow by the fan. As water moves to the condenser, the heat in the condenser vaporizes the water. Due to the vaporized water, the air passing through the condenser changes to high-temperature and high-moisture air, not high-temperature and low-moisture air. In response to the introduction of the high-temperature and high-moisture air into the drum, the drying efficiency may be reduced, which causes an increase in a drying time and energy consumption. That is, the drying performance of the clothes dryer may be reduced.

According to an embodiment, because the edge 114 of the drain hole 112 is formed to be round, water around the drain hole 112 may be guided to the drain hole 112. In addition, by the connection rib 130 provided to partition the drain hole 112, the drain hole 112 may be divided into the plurality of openings 113. The connection rib 130 may be provided to be inclined with respect to the first direction in which the drain hole 112 extends, and also provided to be inclined with respect to the second direction perpendicular to the first direction. Water located on the connection rib 130 may be guided under the connection rib 130 by the inclined structure. By the edge 114 of the drain hole 112 formed to be round and by the connection rib 130 including the double inclination, the condensed water generated in the evaporator 60 may be discharged through the plurality of openings 113 without moving to the condenser 70.

The evaporator mounting member 110 includes the above-described structure, and thus the water condensed in the evaporator 60 may be effectively discharged through the plurality of openings 113. Accordingly, it is possible to reduce the amount of water moving around the condenser 70, and to prevent deterioration of the drying performance of the clothes dryer 1.

Referring to FIGS. 6 and 7, the drain hole 112 may include the plurality of drain holes 112 spaced apart from each other in the second direction. The reason why the plurality of drain holes 112 is arranged to be spaced apart along the second direction is that the evaporator 60 and the condenser 70 are arranged to be spaced apart from each other in the second direction, and the air moves to the second direction to flow to the condenser 70 after the air passes through the evaporator 60. The condensed water may move in the second direction by the flow of air. The plurality of drain holes 112 is arranged to be spaced apart in the second direction, and thus even when the condensed water is not discharged through the first drain hole 112, the condensed water may be discharged through the second drain holes 112 arranged to be spaced apart from each other in the second direction.

Figure 8:
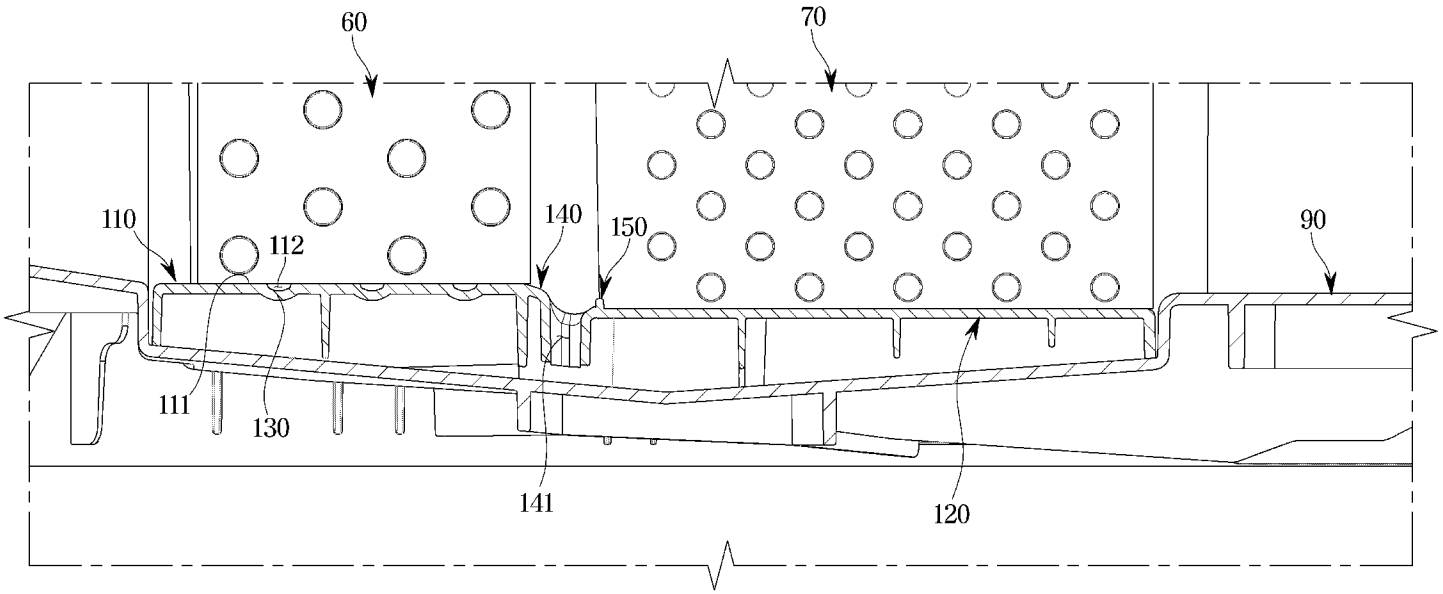
FIG. 8 is a view illustrating a part of a cross section taken along line A-A of FIG. 3.

FIG. 8 is a view illustrating a part of a cross section taken along line A-A of FIG. 3.

Referring to FIG. 8, the condenser mounting member 120 may be provided to be positioned lower than the evaporator mounting member 110.

Because the condenser mounting member 120 is positioned lower than the evaporator mounting member 110, it is possible to increase a volume of the condenser mounted on the condenser mounting member 120. In other words, a height of the condenser 70 may be increased by the difference in height between the evaporator mounting member 110 and the condenser mounting member 120. The evaporator 60 and the condenser 70 have a height limitation due to the surrounding configuration. That is, in the cabinet 10, a maximum height of a space occupied by the evaporator 60 and a maximum height of a space occupied by the condenser 70 are the same. In this situation, one of the methods of increasing the volume of the condenser 70 is reducing the height of the condenser mounting member 120. By reducing the height of the condenser mounting member 120, it is possible to increase a length in the up and down direction of the condenser 70, as described above, and thus it is possible to increase the volume of the condenser 70. Based on an increase in the volume of the condenser 70, the heat exchange efficiency of the condenser 70 may be improved, which may lead to an improvement in the drying efficiency of the clothes dryer 1.

However, based on the condenser mounting member 120 being located lower than the evaporator mounting member 110, the water on the evaporator mounting member 110 may move to the second direction by the flow of air and then move to the condenser mounting member 120. The movement of water to the condenser mounting member 120 may be prevented through the structure of the connection rib 130 and the structure of the edge 114 of the drain hole 112, but some of the water may move to the condenser mounting member 120 without being discharged to the lower side.

In order to prevent this, the support plate 100 according to an embodiment may include a prevention rib 150. The prevention rib 150 may extend in the first direction. The prevention rib 150 may protrude upward so as to prevent that the water moves from one side of the prevention rib 150 to the other side. That is, the prevention rib 150 may function as a wall provided to prevent the movement of water.

According to an embodiment, the prevention rib 150 may be arranged at one end of the condenser mounting member 120. One end of the condenser mounting member 120 may correspond to a region, which is closest to the evaporator mounting member 110, of the condenser mounting member 120. In addition, the one end of the condenser mounting member 120 may refer to a second end of a connection member 140 to be described later.

Because the prevention rib 150 is arranged at one end of the condenser mounting member 120, the water generated in the evaporator 60 may pass through the evaporator mounting member 110 and the connection member 140, and finally, the movement of the water may be limited by the prevention rib 150. That is, an amount of the water moving up to the prevention rib 150 may be minimized.

Referring to FIG. 8, the support plate 100 may include the connection member 140 provided to connect the evaporator mounting member 110 and the condenser mounting member 120 to each other.

The connection member 140 may include a first end connected to the evaporator mounting member 110 and the second end connected to the condenser mounting member 120. The first end of the connection member 140 may be positioned higher than the second end. A plurality of holes 141 may be provided in the connection member 140. The prevention rib 150 may be arranged at the second end of the connection member 140.

The connection member 140 may be provided to connect the evaporator mounting member 110 to the condenser mounting member 120 which have different heights. By the plurality of holes 141, the connection member 140 may discharge water, which moves from the evaporator mounting member 110 to the connection member 140, to the lower side.

Referring to FIG. 8, the evaporator mounting member 110 according to an embodiment may include the flat evaporator support 111. The evaporator support 111 may be formed in a flat shape to increase a contact area with the evaporator 60. As the contact area between the evaporator support 111 and the evaporator 60 increases, the evaporator support 111 may stably support the evaporator 60.

As mentioned above, the clothes dryer 1 according to an embodiment may prevent the water condensed by the evaporator 60 from moving to the condenser 70 by partially changing the shape of the evaporator mounting member 110 without additional components. Accordingly, it is possible to prevent the reduction of the drying performance of the clothes dryer 1. In addition, it is possible to prevent the reduction of the drying performance of the clothes dryer 1 by partially changing only the structure of the evaporator mounting member 110 without additional components. Accordingly, it is possible to improve the drying performance of the clothes dryer 1 without an increase in material cost.

Figure 9:
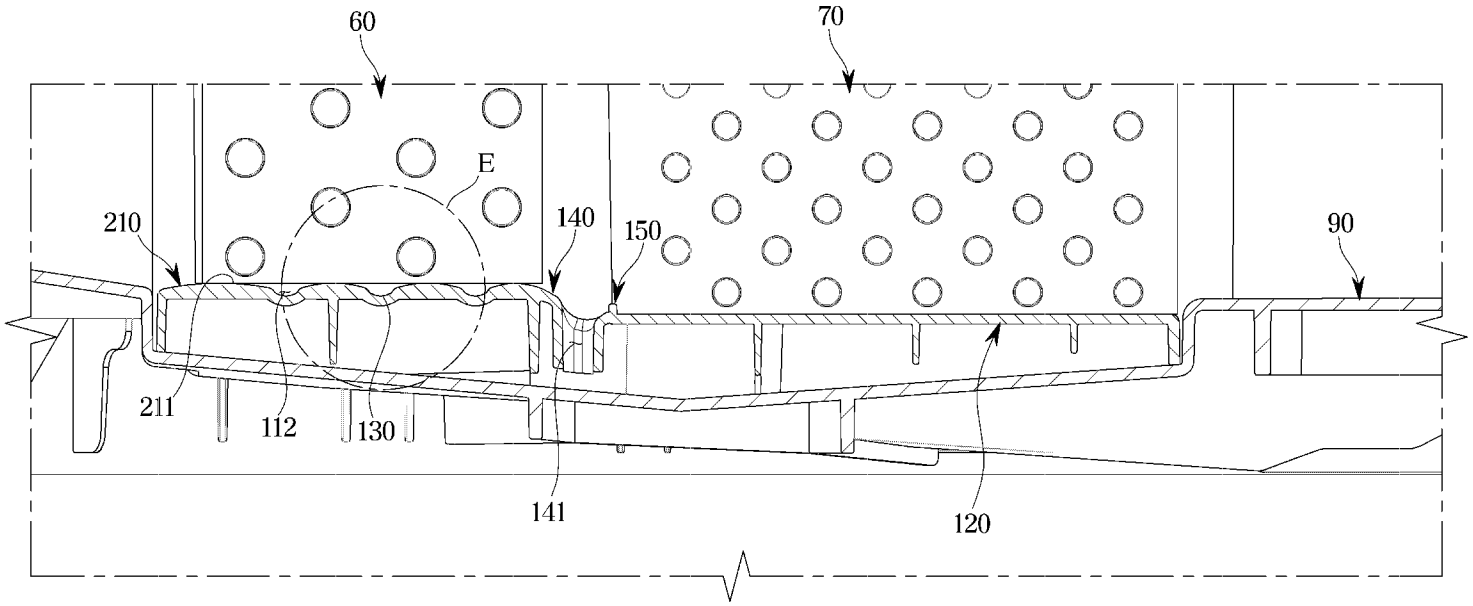
FIG. 9 is a view illustrating a part of a cross section of a clothes dryer according to another embodiment of the disclosure.
Figure 10:
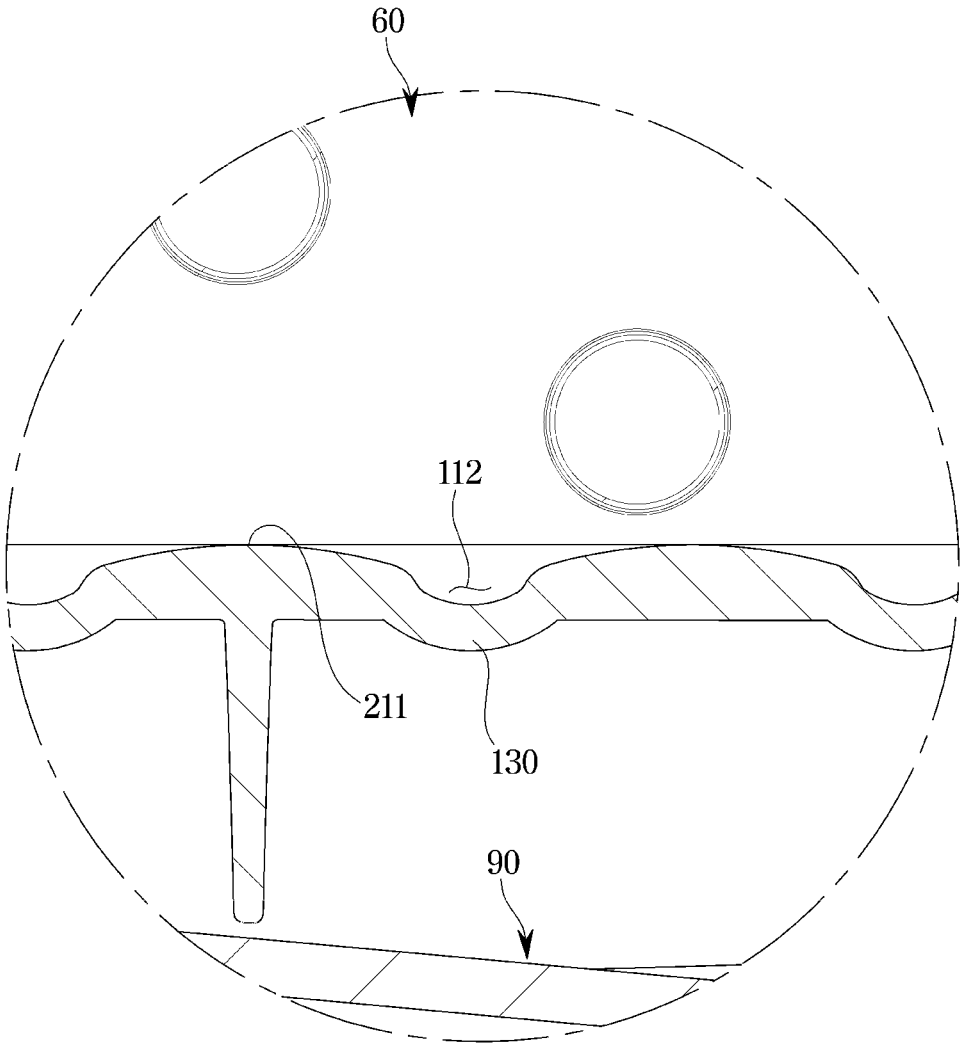
FIG. 10 is an enlarged view of a part E of FIG. 9.

FIG. 9 is a view illustrating a part of a cross section of a clothes dryer according to another embodiment of the disclosure. FIG. 10 is an enlarged view of a part E.

Referring to FIGS. 9 and 10, an evaporator mounting member 210 according to another embodiment may include a curved member 211 convex upward toward the evaporator 60. The curved member 211 may be formed to be convex in the second direction. Components other than the curved member 211 may be provided in the same manner as in the above-described embodiment.

The curved member 211 may be formed to be convex in the second direction, and thus water condensed in the evaporator 60 may be guided to the drain hole 112. Water on the curved member 211 may be guided downward by the convex shape of the curved member 211 and gravity. Accordingly, water condensed in the evaporator 60 may be more effectively discharged through the drain hole 112.

As is apparent from the above description, a clothes dryer may improve a drying performance by facilitating discharge of condensed water.

A clothes dryer may improve a structure, in which an evaporator is mounted, so as to prevent movement of condensed water, which is generated by the evaporator, toward a condenser caused by an air flow inside the clothes dryer.

A clothes dryer may improve a drying performance without an increase in a material cost.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes dryer comprising:

a cabinet;

a drum rotatably arranged inside the cabinet;

a support plate provided in a lower portion of the cabinet, the support plate including a first region and a second region spaced apart from the first region;

a fan configured to generate a circulation airflow that passes through the drum; and a heat pump configured to heat air supplied to the drum, wherein the heat pump comprises:

a compressor configured to compress and supply a refrigerant;

an evaporator mounted in the first region; and a condenser mounted in the second region;

wherein the first region includes:

a plurality of evaporator supports configured to support the evaporator by being in contact with the evaporator, each of the plurality of evaporator supports spaced apart from one another along a direction of the circulation airflow;

a plurality of drain holes formed to penetrate the plurality of evaporator supports, configured to drain water collected on the first region therethrough, extending in a widthwise direction which is perpendicular to the direction of the circulation airflow, and each of the plurality of drain holes is spaced apart from one another along the direction of the circulation airflow; and a plurality of connection ribs extending along the direction of the circulation airflow to partition the plurality of drain holes, each of the plurality of connection ribs connecting adjacent evaporator supports among the plurality of evaporator supports thereby reinforcing a strength of the plurality of evaporator supports, wherein each of the plurality of connection ribs comprises:

a center portion formed in a concave shape from an upper surface of one of the adjacent evaporator supports to an upper surface of an other one of the adjacent evaporator supports in the direction of the circulation airflow; and round portions respectively extending from the center portion in the widthwise direction to guide the water downward into the plurality of drain holes, and wherein each of the plurality of connection ribs is positioned lower than the adjacent evaporator supports connected thereto.

2. The clothes dryer of claim 1, wherein an edge of the plurality of drain holes is inclined downwardly from the plurality of evaporator supports and provided in a curved shape to allow water around the plurality of drain holes to be guided to the plurality of drain holes.

3. The clothes dryer of claim 1, wherein the each of the plurality of connection ribs is arranged space apart from each other in the widthwise direction.

4. The clothes dryer of claim 1, wherein the second region includes a condenser mounting member is positioned lower than the plurality of evaporator supports.

5. The clothes dryer of claim 4, wherein the support plate comprises a prevention rib provided to prevent water from the first region from moving to the second region due to the circulation airflow.

6. The clothes dryer of claim 5, wherein the prevention rib is arranged between the first region and the second region, and extends in the widthwise direction.

7. The clothes dryer of claim 5, wherein the support plate further comprises a connection member to connect the first region and the second region, and comprising a first end connected to the first region and a second end connected to the second region, and the connection member includes a plurality of holes to drain water therethrough.

8. The clothes dryer of claim 7, wherein the second end of the connection member is positioned lower than the first end of the connection member, and the prevention rib is arranged on the second end.

9. The clothes dryer of claim 1, wherein each of the plurality of evaporator supports is formed in a flat shape to increase a contact area with the evaporator.

10. The clothes dryer of claim 1, wherein each of the plurality of evaporator supports comprises a curved member convex upward toward the evaporator.

11. A clothes dryer comprising:

a cabinet;

a drum rotatably arranged inside the cabinet;

a support plate provided in a lower portion of the cabinet, the support plate including:

a first region;

a second region spaced apart from the first region; and a connection region provided between the first region and the second region, and connect the first region and second region together;

an evaporator mounted on the first region;

a condenser mounted on the second region; and a fan configured to generate a circulation airflow to circulate air through the evaporator, the condenser, and the drum, wherein the first region includes:

a plurality of evaporator supports configured to support the evaporator by being in contact with the evaporator, each of the plurality of evaporator supports spaced apart from one another along a direction of the circulation airflow;

a plurality of drain holes to drain water collected on the first region therethrough, extending in a widthwise direction which is perpendicular to the direction of the circulation airflow, and each of the plurality of drain holes is spaced apart from one another along the direction of the circulation airflow; and a plurality of connection ribs extending along the direction of the circulation airflow to partition the plurality of drain holes, each of the plurality of connection ribs connecting adjacent evaporator supports among the plurality of evaporator supports thereby reinforcing a strength of the plurality of evaporator supports, wherein each of the plurality of connection ribs comprises:

a center portion formed in a concave shape from an upper surface of one of the adjacent evaporator supports to an upper surface of an other one of the adjacent evaporator supports in the direction of the circulation airflow; and inclined portions formed from the center portion in the widthwise direction to guide the water downward into the plurality of drain holes, wherein each of the plurality of connection ribs is positioned lower than the adjacent evaporator supports connected thereto, and wherein the connection region includes a plurality of holes extending in the widthwise direction to drain the water collected from the first region therethrough.

12. The clothes dryer of claim 11, wherein the first region is located higher that the second region, and the connection region slopes downward from the first region to the second region to drain the water collected from the first region through the plurality of holes of the connection region.

* * * * *